US007561823B2

(12) United States Patent
Johnson et al.

(10) Patent No.: US 7,561,823 B2
(45) Date of Patent: Jul. 14, 2009

(54) SHORT PASSIVE DUPLEX UNIT AND METHOD OF USE

(75) Inventors: Kevin Matthew Johnson, Georgetown, KY (US); Ronald Todd Sellers, Stamping Ground, KY (US)

(73) Assignee: Lexmark International, Inc., Lexington, KY (US)

( * ) Notice: Subject to any disclaimer, the term of this patent is extended or adjusted under 35 U.S.C. 154(b) by 224 days.

(21) Appl. No.: 11/278,907

(22) Filed: Apr. 6, 2006

(65) Prior Publication Data

US 2007/0237541 A1 Oct. 11, 2007

(51) Int. Cl.
*G03G 15/00* (2006.01)

(52) U.S. Cl. ..... 399/107; 399/364

(58) Field of Classification Search ..... 399/107, 399/364

See application file for complete search history.

(56) References Cited

U.S. PATENT DOCUMENTS 5,391,138 A 2/1995 Abramson et al.
5,412,490 A 5/1995 Kojima et al.
5,887,868 A 3/1999 Lambert et al.
6,476,923 B1 11/2002 Cornell
6,546,228 B2 4/2003 Motohashi et al.

FOREIGN PATENT DOCUMENTS

JP EP 0 574 044 A1 * 9/1989

* cited by examiner

*Primary Examiner*—David M Gray
*Assistant Examiner*—Ruth N Labombard
(74) *Attorney, Agent, or Firm*—Middleton & Ruetlinger

(57) ABSTRACT

A removable duplex unit for an image forming peripheral having a simplex media feedpath and a reversible roller for moving media in a first direction through the peripheral and in a second direction through the duplex unit, includes an auxiliary housing adapted to be removably connected to the image forming peripheral, the auxiliary housing having therein a curved duplex media feedpath of a preselected length extending through the auxiliary housing in feeding communication with the reversible roller in the simplex media feedpath wherein the duplex feedpath in the auxiliary housing is passive and does not provide energy to media passing through the duplex media feedpath.

17 Claims, 12 Drawing Sheets

SHORT PASSIVE DUPLEX UNIT AND METHOD OF USE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to a printing peripheral, and more particularly to a duplex printing peripheral and its method of use.

2. Description of the Related Art

Media feeding has traditionally been performed in a simplex configuration. Simplex feedpaths have been utilized in stand-alone printers and multi-function devices, also known as all-in-one devices, in the form of L-path media feed systems. In L-path media feed systems, the input media is positioned at the rear of the device in a substantially vertical orientation. The L-path media feed system further comprises a substantially horizontal output tray and a printing zone defined between the input tray and the output tray. The media is moved through a feedpath from the substantially vertical orientation to a substantially horizontal orientation. Thus when viewed from a side, the media moves through a substantially L-shape path.

Alternatively, peripheral manufacturers have also utilized C-shaped media feedpaths. A C-path media feed utilizes a substantially horizontally disposed input tray adjacent a substantially horizontally disposed output tray. Typically, the input tray is positioned beneath the output tray and, as such, is also known as a bottom loading device. The feedpath is generally curved from the input tray to the output tray in order to move the media through a print zone and, from a side, is substantially C-shaped. Due to the construction of the C-path media feed, the height of the peripheral or printer is decreased. In other words, the device lacks the large upwardly extending media tray. Further, the media is generally hidden from view within the interior of the printer or multi-function device.

It has further become desirable to include duplex printing capabilities in consumer printing peripheral devices. Traditionally, duplex printing capability has been limited to professional office equipment and costly home-office equipment. One of the factors increasing the cost of traditional duplex capable printers has been the complexity of media feedpath designs. Traditional duplex feedpaths require a plurality of drive rollers and pressure rollers to change media sides and direct the media to the print zone. Thus, the cost of parts binders economic utility as well as the added cost and complexity of implementation into the manufacturing process.

Further, although many users find a duplexing feature desirable, there are those users who only need simplex functionality, for example users who print only photos. For users who additionally desire duplex feeding capability, it would be preferred if these users could purchase and install the duplex unit. However, due to the complexity of existing duplex designs these systems cannot be purchased and added-on by a consumer. Moreover, the complexity of existing duplex designs requires that significant effort be given to their installation during the manufacture of a printing peripheral.

Given the foregoing, it will be appreciated that an apparatus is needed which provides duplex functionality for media feeding, for example, for printing. It is also preferable that the duplex unit be easy to install and limit any chance of damage to the printing peripheral. Further, it is preferable that such design also allows for user installation of an add-on duplex unit or, alternatively, such design be available for final installation during manufacture so that the manufacturer can more closely correlate installation of duplex units to sales forecasts.

SUMMARY OF THE INVENTION

The present invention provides a connectable passive duplex housing for use with a simplex media feedpath to convert the simplex media feedpath to a duplex media feedpath.

According to a first exemplary embodiment, a removable duplex unit for an image forming peripheral having a simplex media feedpath and a reversible roller for moving media in a first direction through said peripheral and in a second direction through the duplex unit, comprises an auxiliary housing adapted to be removably connected to the image forming peripheral, the auxiliary housing having therein a curved duplex media feedpath of a preselected length extending through the auxiliary housing in feeding communication with the reversible roller in the simplex media feedpath wherein the duplex feedpath in the auxiliary housing is passive and does not provide energy to media passing through the duplex media feedpath. The duplex media feedpath is substantially C-shaped with an entry end and an exit end. The removable duplex unit further comprises a first roller in the image forming peripheral positioned intermediate the exit end of the duplex media feedpath and the reversing roll housing, the first roller in feeding communication with the simplex media feedpath and the exit end of the duplex media path. A distance from the reversible roller through the duplex media feedpath and returning to the reversible roller is greater than a length of media being fed therethrough. A distance from the reversible roller through the duplex media feedpath and returning to the first roller is approximately equal to a length of media being fed therethrough. The removable duplex unit further comprises a releasable connector between the peripheral device and the auxiliary housing. The reversible roll is one of a feed roller and an exit roller. The image forming peripheral has at least one sensor adjacent the reversible roller for determining at least one of media leading edge position, media trailing edge position. The image forming peripheral has a gate operable to move to a first position for directing media being fed from the reversible roller into the entry end of the duplex media feedpath and operable to move to a second position for directing media being fed on the simplex media feedpath to the reversible roller.

According to an exemplary embodiment, an auxiliary duplex unit for an image forming, media feeding peripheral having a simplex media feedpath and a reversible roll for moving media in a first direction through the peripheral and in a second direction through the duplex unit, comprises a duplex housing removably connectable to the peripheral, the duplex housing having a duplex feedpath extending therethrough, the duplex feedpath having a first end and a second end adapted for feeding communication with the simplex media feedpath, the duplex feedpath having a length from the reversible roller, through the duplex housing, and to the reversible roller which is longer than a media sheet. The auxiliary duplex unit further comprises a feedpath nip in the primary media feedpath and disposed between the second end of the curvilinear path and the reversible roller. The media is driven through the duplex housing by the reversible roller and wherein no energy is added within the duplex housing the media moving therethrough. The duplex housing is passive. The curvilinear feedpath provides duplex capability to the primary media feedpath. The auxiliary duplex unit further comprises a sensor disposed along the primary media feedpath between the second end of the duplex media feedpath and the reversible roller.

According to yet a further exemplary embodiment, a method of preventing invalid media sizes from entering a passive duplex unit accessory communicatively coupled to a image forming peripheral device having a simplex media feedpath, a first driven roll and second driven roll therein and an sensor disposed along the simplex media feedpath, the duplex housing adapted to be removably connected to the peripheral device having a duplex media feedpath extending through the duplex housing; with the duplex media feedpath having a first upper end and a second lower end in feeding communication with the simplex media feedpath and having a length from the second roll, through the duplex media feedpath, and to the second roll longer than a media sheet; comprises directing the media into the simplex media feedpath with the first roll, recording a leading edge of a media at the sensor, counting second roll indexing movements; recording the trailing edge of the media at the sensor; calculating media length based on the recordings and the counting; performing based on the calculating one of allowing duplex printing operation and suppressing the duplex printing operation. The method further comprises posting a message when the duplex printing operation has been suppressed. The method further comprises determining whether a media length is greater than a maximum length for use in the passive duplex housing. The method further comprises determining whether a media is less than a minimum length for use in the passive duplex housing. The sensor is one of a staging sensor and an end-of-form sensor. The method, wherein performing the duplexing operation further comprises, printing an image on a first side of the media while using the second roller to direct the media through a print zone in the peripheral device; reversing the second roller and directing the media into the duplex unit and past the first roller, the duplex unit for inverting the media from its first side to its reverse side; using the first roller to feed the inverted media to the second roller; and reversing the second roller and directing the reverse side of the media into the print zone for printing.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
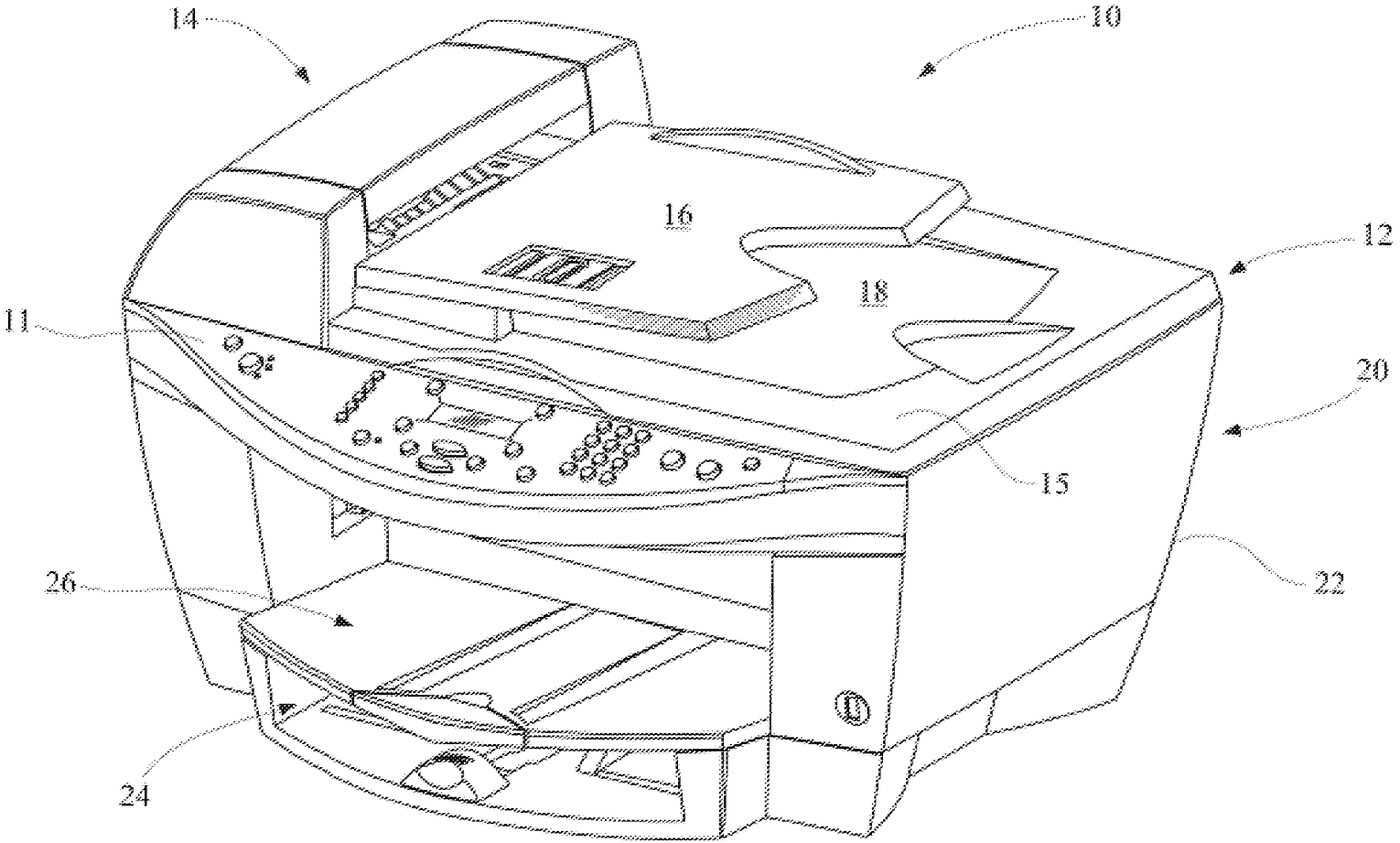
FIG. 1 is a perspective view of the exemplary all-in-one peripheral device having a printer and short passive duplex unit of the present invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "mounted," and "communication" and variations thereof herein are used broadly and encompass direct and indirect connections, couplings, mountings and communications. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

The term image as used herein encompasses any printed or digital form of text, graphic, or combination thereof. The term output as used herein encompasses output from any printing device such as color and black-and-white copiers, color and black-and-white printers, and all-in-one devices that incorporate multiple functions such as scanning, copying, and printing capabilities in one device. Such printing devices may utilize ink jet, dot matrix, dye sublimation, laser, and any other suitable print formats. The term button as used herein means any component, whether a physical component or graphic user interface icon, that is engaged to initiate output. The term passive should be understood to mean a device lacking electrical or mechanical energy input. The term ?short? should be understood to mean the duplexing media feedpath must be of a pre-selected range of length relative to the media passing therethrough. The terms upstream and downstream are relative to the media feedpath.

Referring now in detail to the drawings, wherein like numerals indicate like elements throughout the several views, there are shown in FIGS. 1-12 various aspects of a passive duplexing unit. The passive duplexing unit is connectable to a peripheral device having a simplex media feedpath for easily converting the simplex feedpath into a duplex capable feedpath. For ease of description, the following embodiment relates to a simplex/duplex printer conversion, but it is well within the scope of the present invention to utilize the short passive duplex unit with an ADF scanner or copier.

Figure 2:
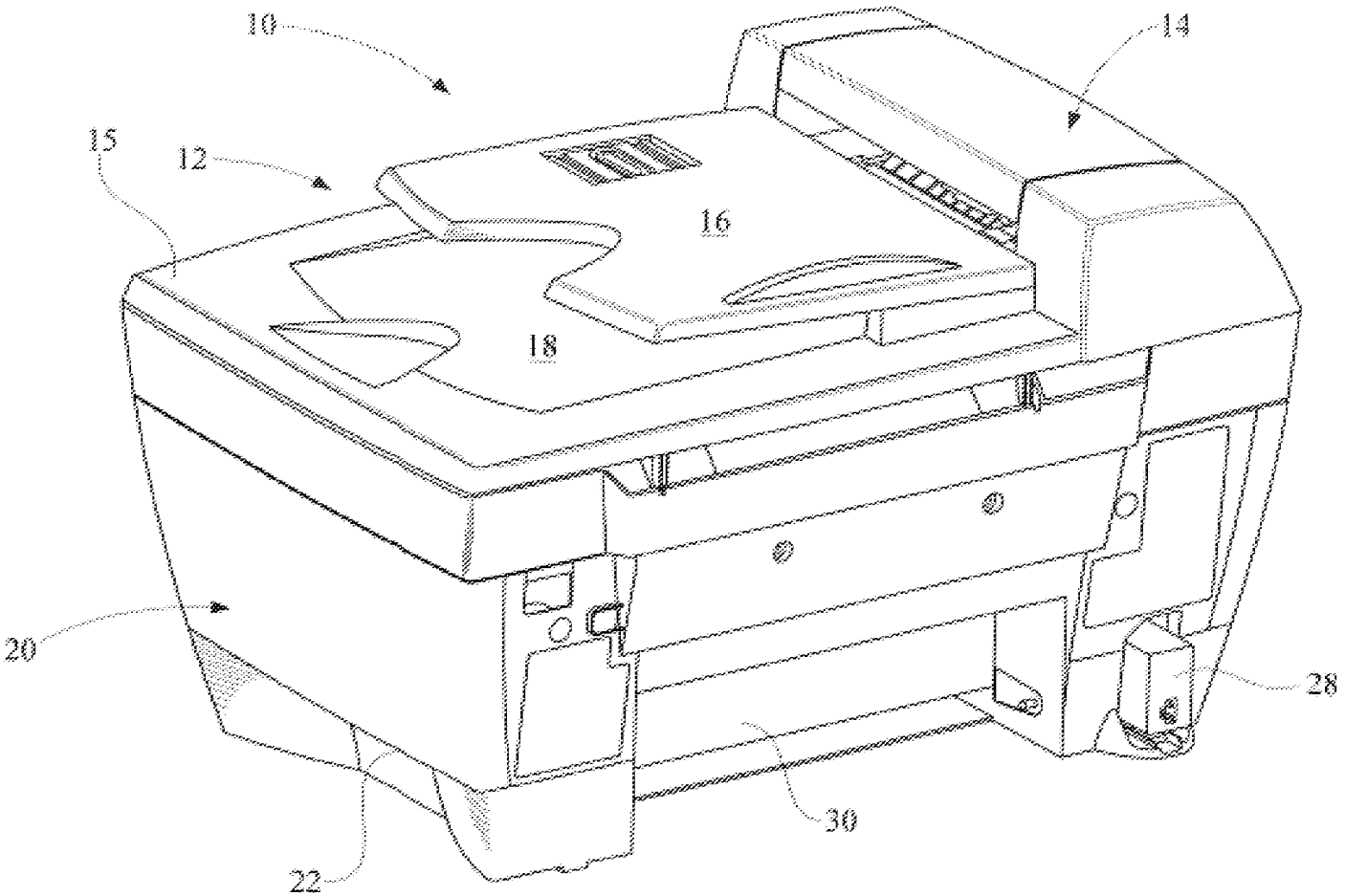
FIG. 2 is a rear perspective view of the all-in-one peripheral device of FIG. 1 with the short passive duplex unit removed.

Referring initially to FIGS. 1 and 2, a multi-function peripheral device 10 is shown having a scanner portion 12 and an image forming apparatus or printer 20 included therewith. The peripheral 10 further comprises a primary housing 22 wherein the mechanical parts are contained for scanning and printing. The housing 22 is generally box-like in shape but various geometrics may be utilized. Within the primary housing 22 is a printing portion 20 that may be defined by a laser printer, a thermal inkjet printer, a piezo-electric inkjet printer, dye sublimation or other image forming technology. The printer or image forming apparatus 20 may include a C-shaped simplex feedpath 34 (FIG. 5) which extends from a lower input tray 24 to an upper output tray 26. One skilled in the art will understand that the present invention may utilize alternative simplex feedpath designs, such as an L-shaped feedpath and that such designs are well within the scope of the present invention. The C-shaped feedpath 34 is shown merely for ease of description. The exemplary embodiment includes a lower support surface 24 for receiving and supporting a plurality blank of media sheets and an upper support surface 26 for receiving and supporting the media after the printing process. The multifunction peripheral device 10 may also comprise a control panel 11 including a plurality of buttons and a display, such as a liquid crystal display (LCD), providing various notifications, menus, and selection options.

Referring still to FIGS. 1 and 2, the scanner portion 12 generally includes a flat bed scanner, generally indicated beneath a flat-bed scanner lid 15 and an auto-document feed (ADF) scanner 14. The ADF scanner 14 comprises an input tray 16 and output tray 18. The ADF input tray 16 receives and supports one or more stacked documents for feeding one sheet at a time through the scanner 14. The ADF output tray 18 receives and supports the documents following the scanning process and is generally formed on the upper surface of the scanner lid 15. The flat-bed scanner comprises a transparent platen beneath the lid 15 for manual positioning of target media for scanning. The flat bed scanner is generally used to scan media not suitable for feeding, such as photos. The scanner portion 12 is generally disposed on an upper portion of the peripheral device 10 above the printing portion 20 although alternate configurations may be utilized. The scanner lid 15 is hingedly attached along the rear edge of the housing 22. The lid 15 may be moved with respect to a scanner bed between a closed position shown in FIGS. 1 and 2 and an open position (not shown) revealing the transparent platen.

Within the scanning portion 12 is an optical scanning unit having a plurality of parts which are not shown but generally described herein. The scanning unit comprises a scanning motor and drive which connects the scanning motor and a scan bar which is driven bi-directionally along a scanning axis defined as the longer dimension of the scanner bed. The scan bar may include a lamp, an image sensor, a lens and at least one mirror therein for obtaining a scanned image from a document. The scan bar may be an optical reduction scanner or a contact image sensor (CIS). The ADF scanner moves media past the scan bar when the scan bar is in the home position. Alternatively, for flat bed scanning, at least one guide bar may be disposed within the scanner bed and extend in the direction of the scanning axis to guide the scanning unit along the scanning axis. The scan bar moves within the scanner bed beneath the platen and the lamp illuminates the document positioned on the platen. For optical reduction scanners, mirrors and lenses located within the scan bar direct the image reflected from the document to the image sensor. The image sensor then determines the image and sends data representing the image to onboard memory, a network drive, or a PC or server housing a hard disk drive or an optical disc drive such as a CD-R, CD-RW, or DVD-R/RW. As is known in the art, a similar process occurs with the CIS-type of image sensor. Alternatively, the original document may be scanned by the optical scanning component and a copy printed from the printing component 20 such as with a multi-function peripheral.

Figure 3:
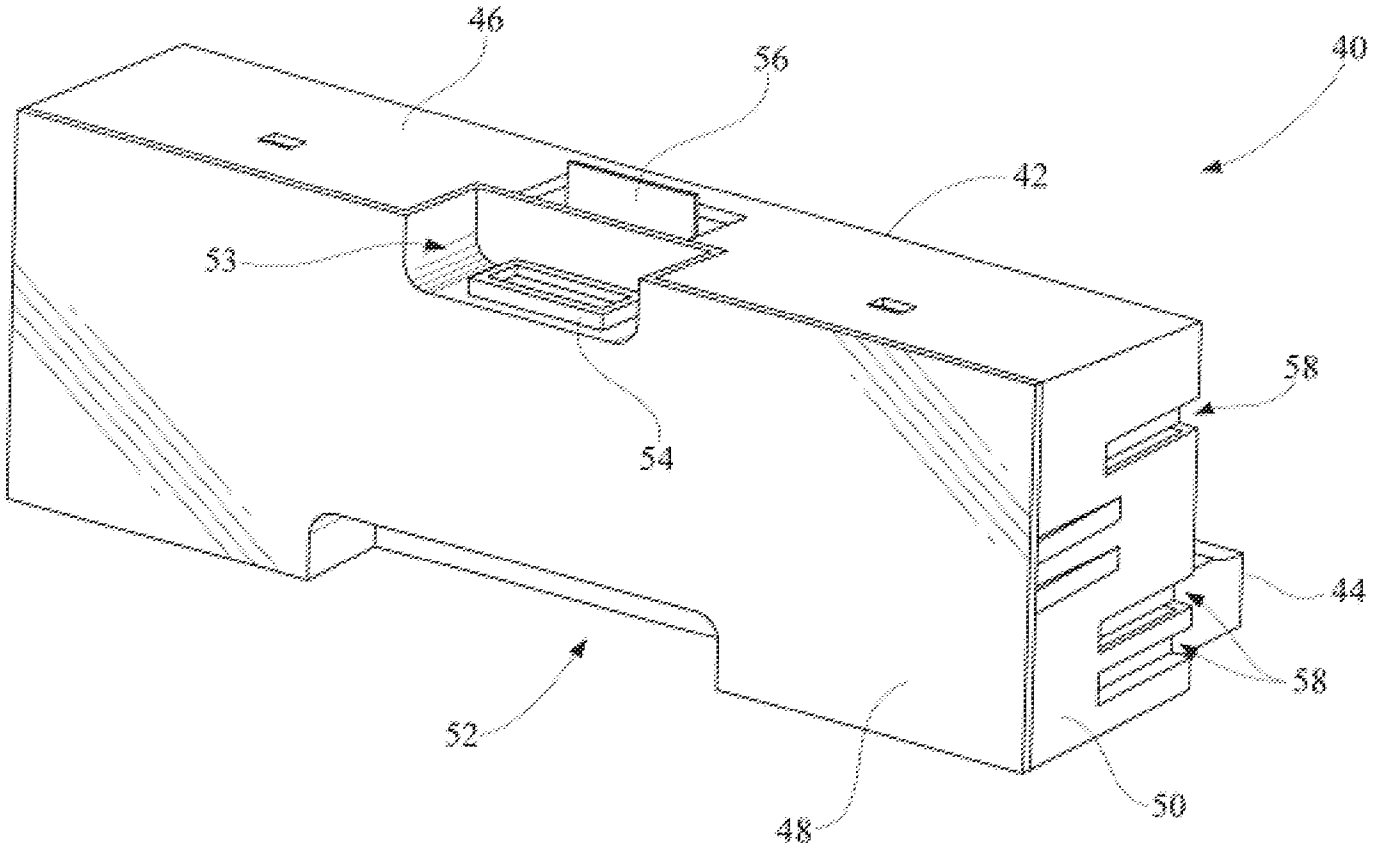
FIG. 3 is a perspective view of the short passive duplex unit of the present invention.

Referring now to FIG. 2, a rear perspective view of the multi-function peripheral or all-in-one device 10 is shown. Along the rear surface of the primary housing 22 is a power adapter 28 wherein a power cord is plugged to electrically power the device 10. Adjacent the power adapter 28 and centrally disposed in a lower portion of the rear surface of the all-in-one device 10 is a duplex unit docking area 30. The docking area 30 is generally rectangular in shape but may comprise alternative shapes corresponding to a duplex unit 40 (FIG. 3). The docking area 30 receives the short passive duplex unit 40 of the present invention converting a simplex print feedpath to a duplex feedpath. The present invention may be installed by the end-user or as a final step of manufacturing. When the duplex unit 40 is not utilized, a cover (not shown) may be disposed over the docking area 30.

Referring now to FIG. 3, a perspective view of the short passive duplex unit 40 is depicted. The short passive duplex unit 40 is substantially L-shaped and defined by a body 42 and a tongue 44 extending from a lower portion of the body 42. Alternatively, however, the short passive duplex unit 40 may be any shape which corresponds to the shape of the duplex unit docking area 30 and provides an aesthetically pleasing design to the rear surface of the device 10. The body 42 has an upper surface 46 and an opposed lower surface (not shown). The body 42 further comprises a rear surface 48 and opposed side surfaces 50. The rear surface of the body 42 is substantially rectangular in shape with a lower recess 52 that defines a handle wherein a user's fingers may be disposed to hold the short passive duplex unit 40. Above the lower recess 52 is an upper recess 53 wherein a release button 54 is disposed. The release button 54 is easily operated by a user's thumb when the fingers are disposed within the lower recess 52 or vice versa. When the release button 54 is depressed, a connector 56 moves downward with the release button so that the short passive duplex unit 40 may be inserted or removed from the primary housing 22. The release button 54 and connector 56 are biased to a normally upward position. When the short passive duplex unit 40 is inserted into the docking area 30 and the release button is released, the connector 56 locks the secondary housing or body 42 within the duplex unit docking area 30. The side surfaces 50 each comprise a plurality of alignment slots or channels 58 which are aligned with corresponding guides 39 (FIG. 4).

The short passive duplex unit 40 and duplex media path 50 do not comprise any rollers and merely utilize the feed rollers already existing in the primary housing 22 of the simplex feedpath 34. In this way, no electrical or mechanical power needs to be supplied to the passive duplex unit 40. Further, no mechanical moving parts are necessary within the duplex housing 42 or tongue 44. This adds to the simplicity of the design allowing for easy installation by an end user or as a final installation step during manufacturing if, for example, sales forecast dictate at more duplex printers are desired in the market place.

Figure 4:
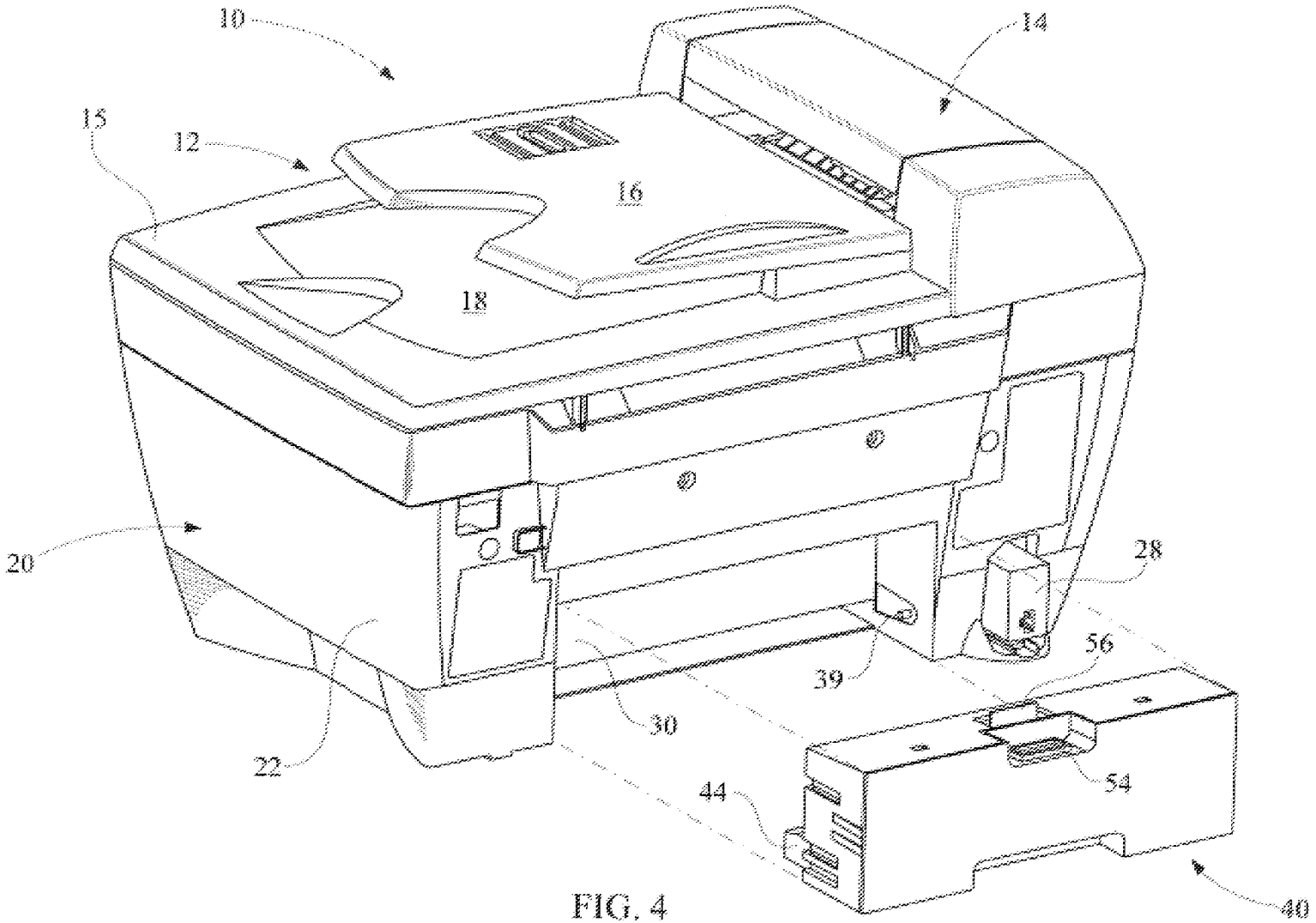
FIG. 4 is an exploded rear perspective view of the all-in-one peripheral device including the short passive duplex unit aligned for installation.

Referring now to FIG. 4, a rear perspective view of the all-in-one device 10 is depicted. The short passive duplex unit 40 is shown aligned for insertion into the rear surface of the device 10. As the short passive duplex unit 40 is moved into the duplexing unit docking area 30, the release button 54 is depressed causing the movable connector 56 to lower allowing easy installation of the duplexing unit 40. Once the unit 40 is fully inserted, the button 54 is released and the connector 56 engages a catch (not shown) within the housing 22. Alternatively, the front surface of the connector 56, i.e. the surface facing the inner portion of the docking area 30, may be tapered so that the release button 54 moves downward as it engages the catch in housing 22 and therefore need not be depressed in order to insert the duplexing unit 40.

Figure 5:
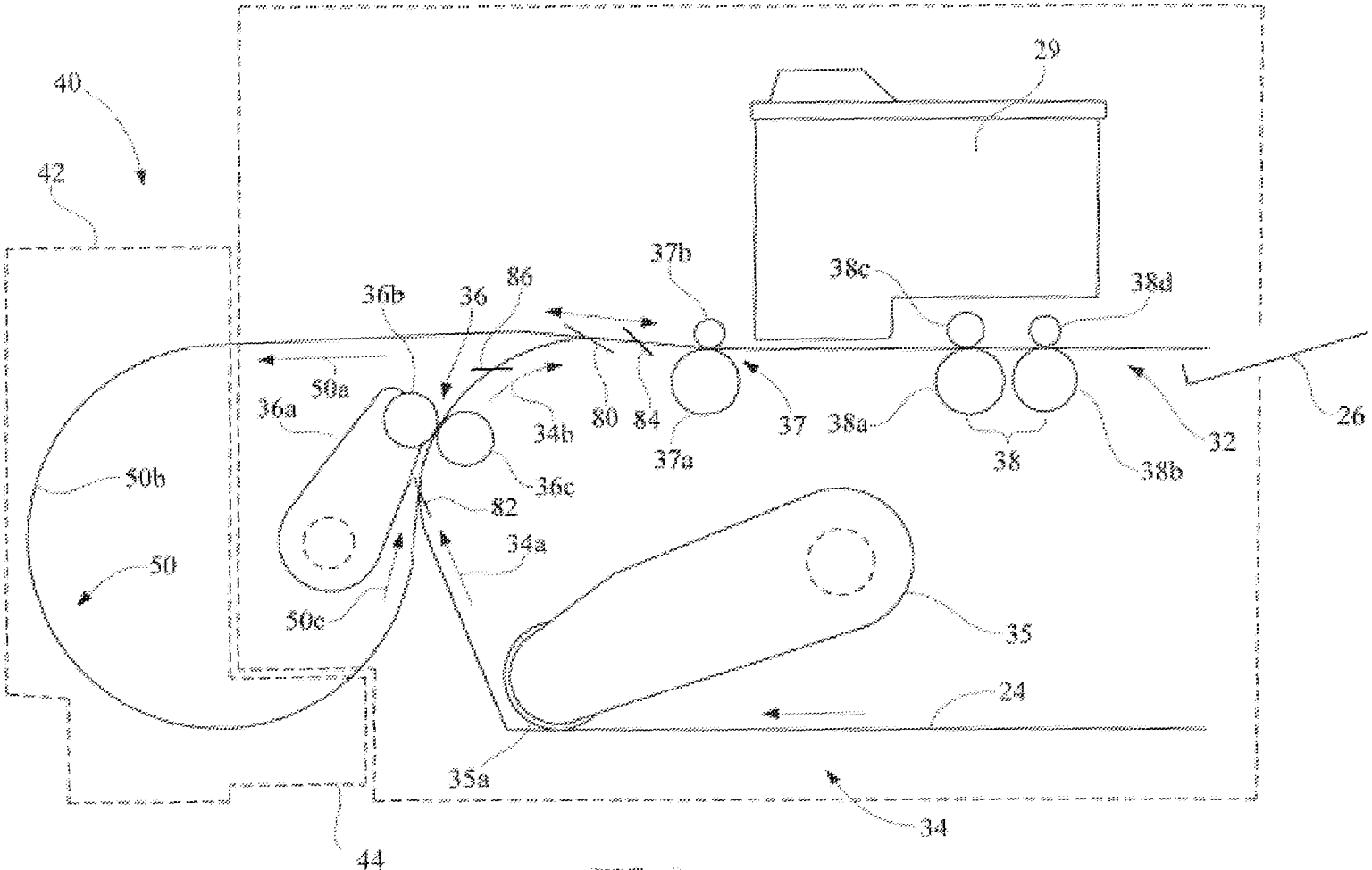
FIG. 5 is a schematic drawing of the media feedpath of the peripheral device of FIG. 1, including the short passive duplex feedpath.

Referring now to FIG. 5, a schematic side view of the media feedpath 32 is depicted including the short passive duplex unit 40. The media feedpath 32 comprises a C-shaped simplex path 34 and the duplex media path 50 extending through the duplex unit 40. The C-shaped simplex path 34 begins at the input tray 24 where a plurality of blank media (not shown) is stored. The media is picked one sheet at a time by the media pick mechanism such as an auto-compensating mechanism (ACM) 35 and directed into the simplex path 34. The auto-compensating mechanism ACM 35 is know to one skilled in the art and therefore will not be described herein. As the media is moved one sheet at a time, the media moves upward into the simplex path 34 through the portion labeled 34*a*. Downstream along the simplex path 34 is a first nip or C-path nip 36 defined by a C-path ACM 36*a* having a driven ACM C-path roller 36*b* and an opposite C-path pressure roller 36*c*. The ACM 36*a* may be pivotable to move roller 36*b* and, in turn, open and close the nip 36. Alternatively, the ACM 36*a* may be fixed in an engaged position with pressure roller 36*c*. The C-path ACM 36*a* and opposite C-path pressure roller 36*c* receive the media leading edge and advance the media in the C-path feed direction from the pick roller 35*a* toward a first staging sensor 86. The first sensor 86 signals print processor (not shown) of the media location in the feedpath 32 and may signal to close the ACM 36*a* with pressure roller 36*c* if the ACM 36*a* is of the pivotable type. The first sensor 86 is also triggered by the leading edge of media during the duplex feeding to locate the media in the feed path 32. The print processor is programmed with a know distances from the first sensor 86 to various locations in feedpath 32, including the feed nip 37.

Downstream from the first sensor 86 is a gate 80 located generally at a junction between the simplex feedpath 34 and upper portion of duplex path 50*a*. The gate 80 inhibits a trailing edge of media from being reversed from a nip 37 into the simplex path 34. Alternatively stated, the gate 80 directs media moving from feed nip 37 toward the duplex path 50.

Downstream of the gate 80 is a second end of form sensor 84. The second sensor 84 also locates the media within feedpath 32 so that the processor can determine the location of the media relative to the feed nip 37. The feed nip 37 is defined by a reversibly driven feed roll 37*a* and an opposite pressure roll 37*b* which directs the media toward and away from a print zone by reversing the at least one drive motor (not shown).

Downstream of the feed nip is the print cartridge 29 which selectively ejects ink onto one or both surfaces of the media during simplex or duplex printing, respectively. The feed nip 37 indexes media between print cartridge and a mid-frame (not shown) wherein a print zone is defined. Opposite the feed nip 37 downstream along the feedpath 32 is an exit drive system 38 comprising at least one driven roller and opposed pressure roller. The exemplary embodiment shows two rollers which may be driven 38*a* and 38*b* into respectively opposed pressure rollers 38*c* and 38*d*. The exit driven system receives media from the feed nip 37 and directs media to the output tray 26. Downstream of the exit drive system 38 along the media path 32 is the output tray 26 which receives finished printed media.

Adjacent the C-shaped simplex path 34 is the short passive duplex unit 40 having a duplex media feedpath 50 therein. The duplex media feedpath 50 is in feeding communication with the C-shaped simplex path 34 to provide a printing unit which will convert from simplex feeding to duplex feeding easily. Extending from the feed nip 37 toward the short passive duplex unit 40 is a first section of the duplex media feedpath 50*a*. The first section of the duplex feedpath 50*a* extends from an intersection with the simplex path 34*b* adjacent the feed nip 37 and into the passive duplex unit 40. The duplex feedpath 50 further comprises a second section 50*b* which is substantially C-shaped and extends through the housing 42 and tongue 44. The second section 50*b* is defined by inner surfaces within the housing 42. Extending between the tongue 44 and the C-path nip 36 is a final portion of the duplex media path 50*c*. It should be understood that the connecting first portion 50*a* and third portion 50*c* of the duplex path 50 are disposed within the primary housing 22 while the portion of the duplex path 50*b* extends through the duplex housing 42 and tongue 44.

Figure 6:
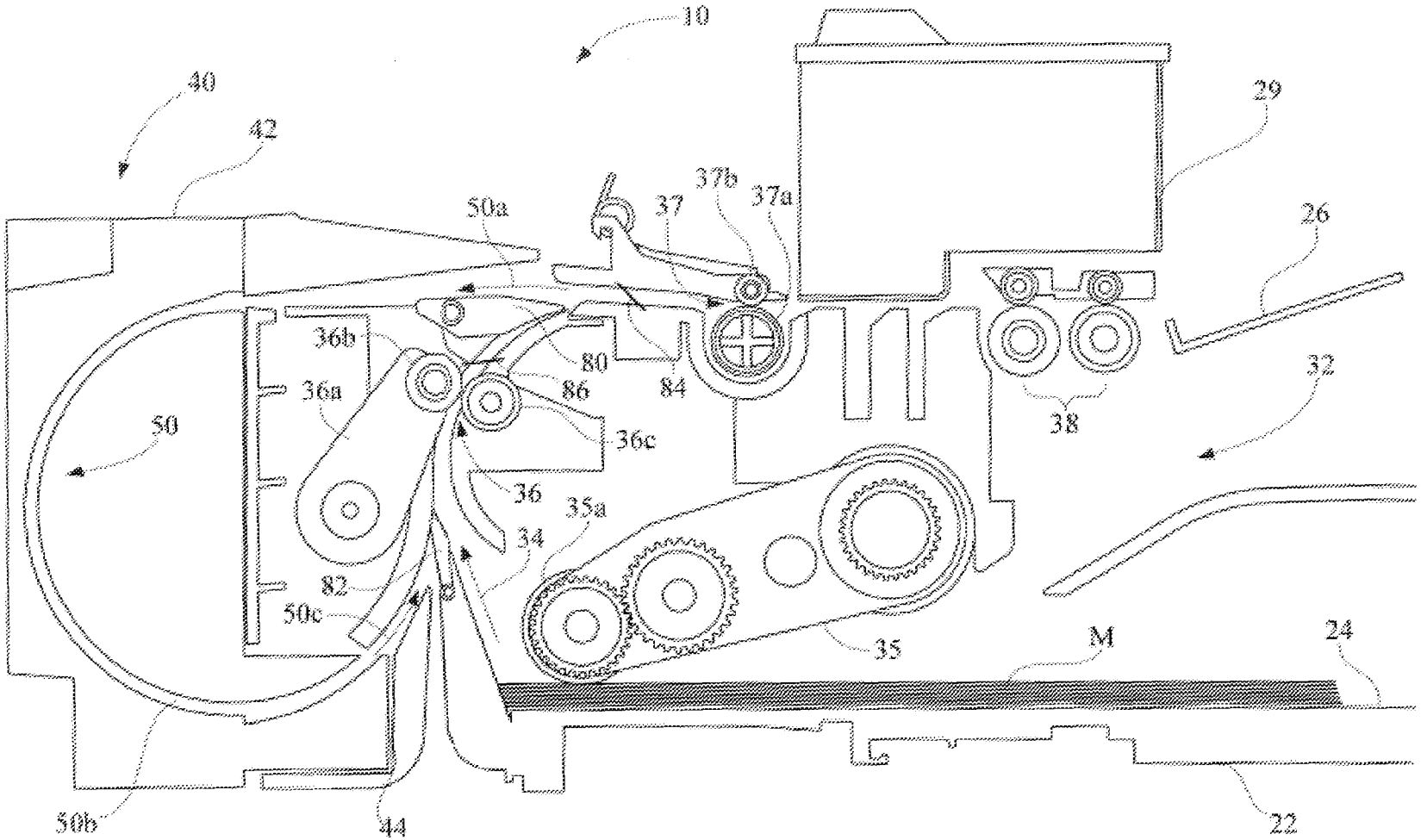
FIG. 6 is a side view of the media feedpath of the present invention.

FIGS. 6-11 depict a sequence of side-views wherein media M moves through the all-in-one device 10 during a duplex feeding process. Referring first to FIG. 6, a side view of an exemplary embodiment of the present invention is depicted. Specifically, the figure depicts the primary housing 22 with the duplex housing 42 connected at the rear end of the device 10. Within the input tray 24 is a stack of media M engaged by the ACM 35 and ACM roller 35*a*.

Figure 7:
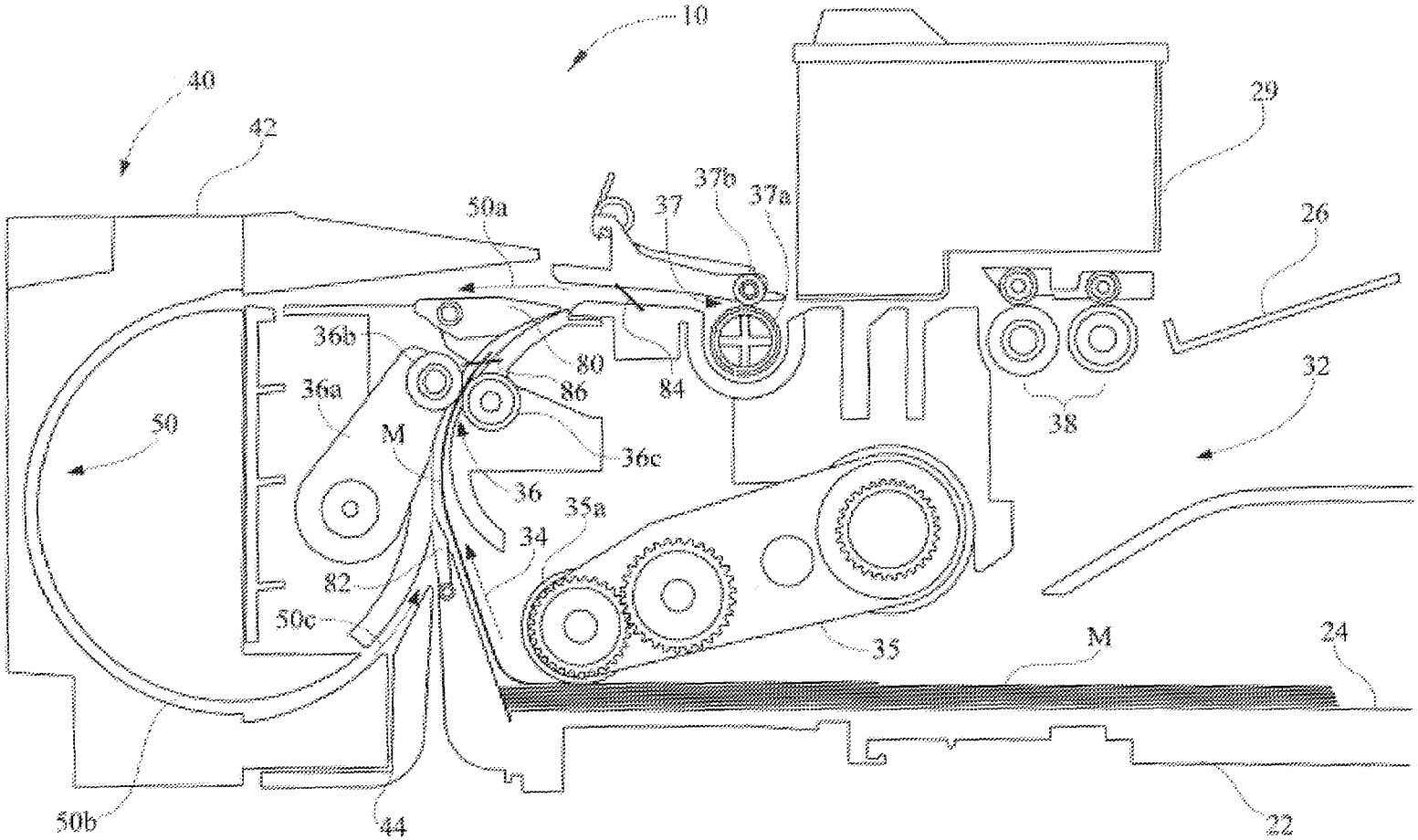
FIGS. 7-11 are sequence views of media passing through the peripheral device and short passive duplex unit; and, FIG. 12 is a flow chart depicting the decisions made in order to feed media through the short passive duplex unit.

Referring now to FIG. 7, the media stack M is shown disposed in the input tray 24. The ACM 35 and ACM roller 35*a* have engaged the uppermost sheet of the media and indexed the media sheet M further along the simplex feedpath 34. The media M is shown moving upward and into further driving engagement with the first nip 36 defined between the first roll 36*b* and first pressure roll 36*c*. According to one embodiment utilizing a movable ACM 36*a*, the ACM 36*a* pivots closed into driving engagement with the pressure roller 36*b* when the media M triggers the staging sensor 86.

Figure 8:
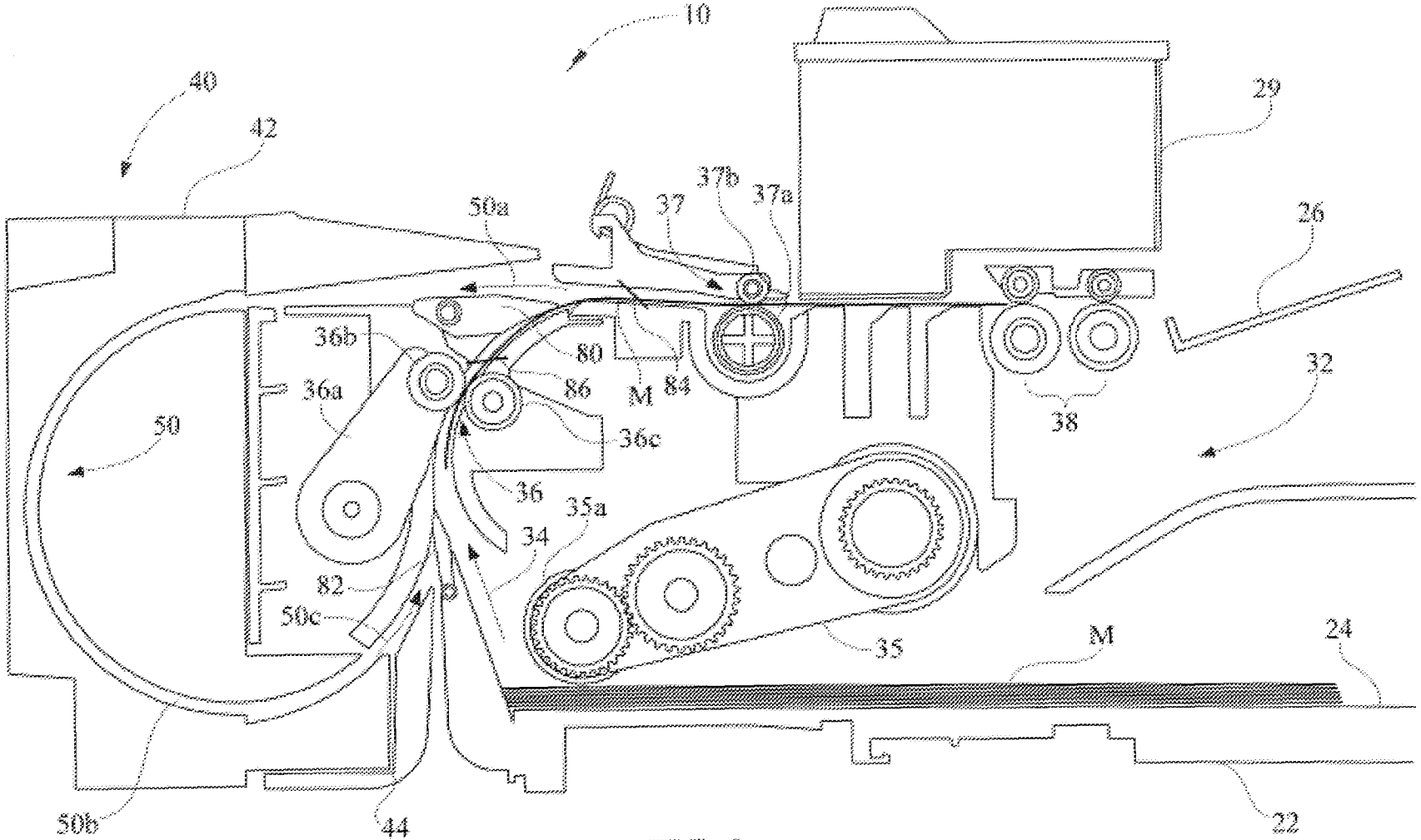

Referring now to FIG. 8, the media M is advanced from the C-path nip 36 through sensor 86, gate 80 and sensor 84 to the second nip 37, which indexes the media M into the print zone beneath the print cartridge 29. The media M is indexed into the print zone and always remains in contact with the second nip 37 as the media is indexed through the print zone. In one embodiment, before the trailing edge of the media M passes from the feed nip 37, the media direction is reversed. In another embodiment allowing for printing to the trailing edge of the media M, the media direction may be reversed at the exit rollers 38 to reverse the media direction when the motor (not shown) for these rollers is reversed. As previously indicated, the gate 80 is disposed between the C-path nip 36 and the feed nip 37 and moves downward as the trailing edge of the media passes therethrough so that media M cannot be directed downward toward the first nip 36 from the second nip 37 when the motor (not shown) is reversed. The gate 80 may be spring biased or use some other biasing device in order to close the media feedpath 32.

Figure 9:
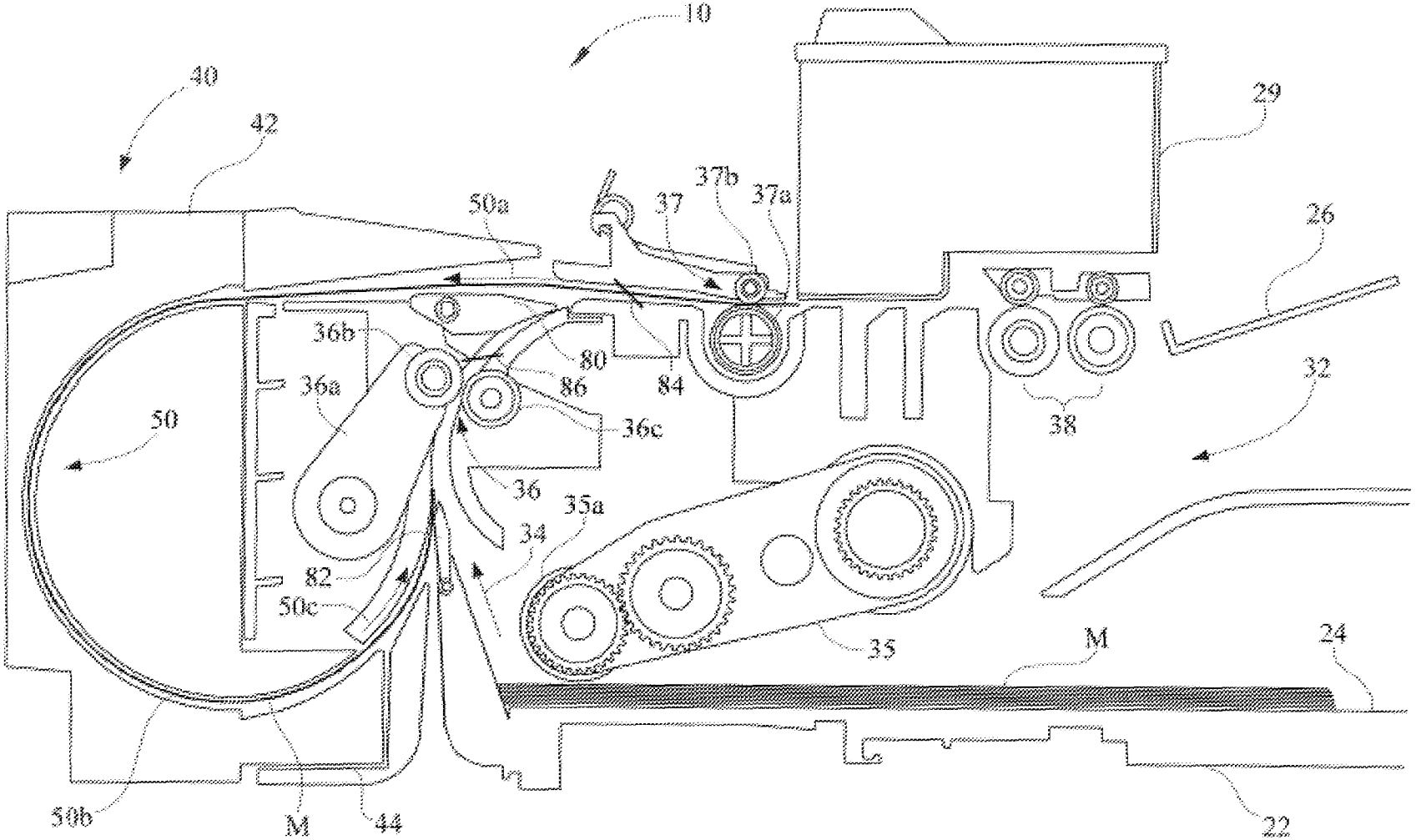

Referring now to FIG. 9, the media M is indexed through the duplex media feedpath 50 by the second nip 37. The media M extends from the primary housing 22 through the duplex housing 42 and the tongue 44. The media M exits from the tongue 44 back into the primary housing and into the first nip 36. In this way, the leading edge of the media M is driven by the first nip 36 before the trailing edge of the media M is released from the second nip 37. Alternatively, the ACM 36*a* may be pivotable wherein the nip 36 remains in an open position until the first sensor 86 is triggered causing the ACM 36*a* to move and engage the media M for feeding.

As previously indicated, the duplex unit of the present invention does not utilize rollers along the interior feedpath 50*b*. Instead, the duplex path 50 merely guides the media M as it is driven by the feed nip 37 and C-path nip 36, both in the primary housing 22. While this design improves the ease of use and installation and converts the simplex feedpath to a duplex feedpath, the design imposes limitations on the length of media which may be utilized. In order to prevent the media from becoming undriven in the feedpath 50, the distance from the second nip 37, through the duplex unit 40 and to the first nip 36 should be shorter than the length of the shortest media to be duplexed. Alternatively stated, the media M should have a length that is greater than the length from the second nip 37 to the first nip 36 when passing through the duplex unit 50.

Figure 10:
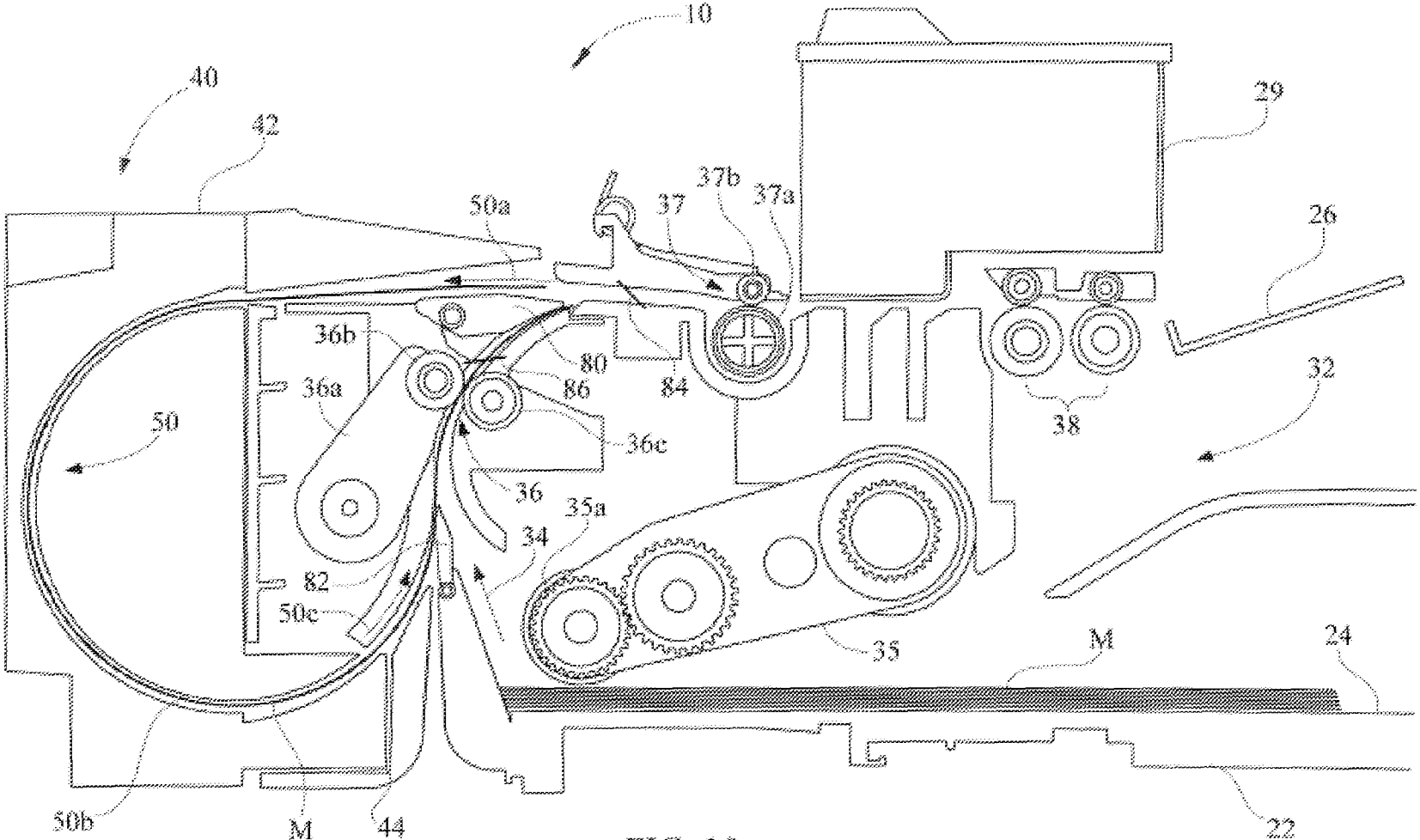

Referring now to FIG. 10, the media M is released from the feed nip 37 and is driven by the C-path nip 36 back towards the print cartridge 29. One skilled in the art will understand that as the media M is advanced through the duplex unit 40, the media changes orientation relative to the print cartridge 29. Specifically, as the media M first passes the print cartridge 29 via the simplex path 34, the first (obverse) side of the media M is exposed to the print cartridge 29. As the media M reverses direction and passes through the duplex unit 50, the media M returns to the print cartridge 29 with the second (reverse) side of the media M is exposed to the print cartridge 29 for the duplex printing process. Thus, by adding the duplex unit 40 to the primary housing 22, the printer 20 is converted from a simplex printer to a duplex printer easily and conveniently.

If the media is of a shorter acceptable length for duplex feeding, the trailing edge of media M may pass the second sensor 84 as it leaves the nip 37. However, if the media M is of a longer acceptable length, the media trailing edge may not pass the second sensor 84 before the leading edge reaches the first sensor 86. Therefore, it should be understood that either or both sensors 84,86 may be utilized to locate the media M in the feedpath 32 and so that the processor can calculate the distance of the leading edge to the feed nip 37 for the duplex pass by the print cartridge 29.

Figure 11:
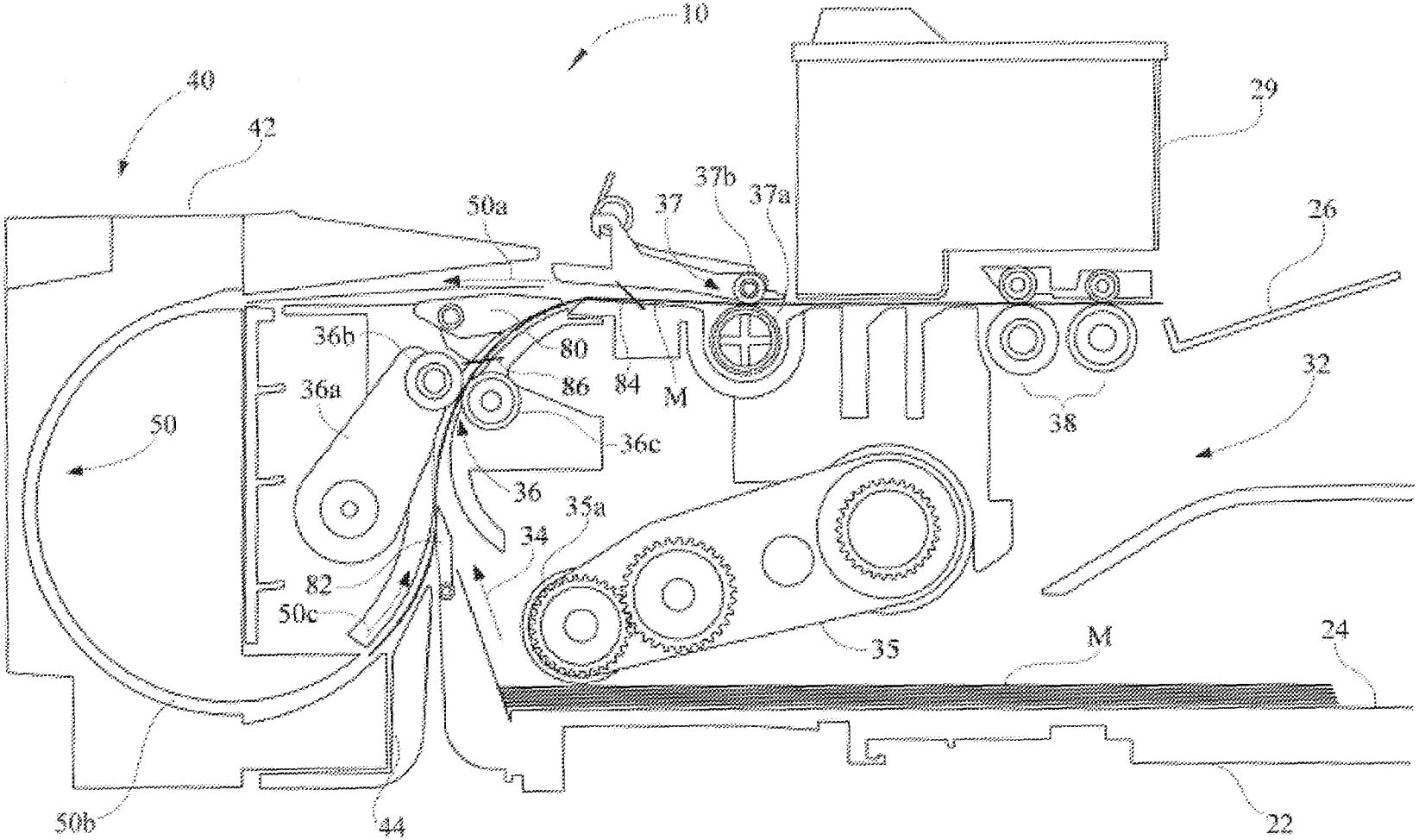

Referring now to FIG. 11, the media M is shown passing from the duplex unit 40 to the primary housing 22. The media M is driven by the C-path nip 36, through the feed roll nip 37 and under the print cartridge 29. As a result the media M is ready to start its discharge to the output tray 26, signaling completion of a duplex printing cycle.

Figure 12:
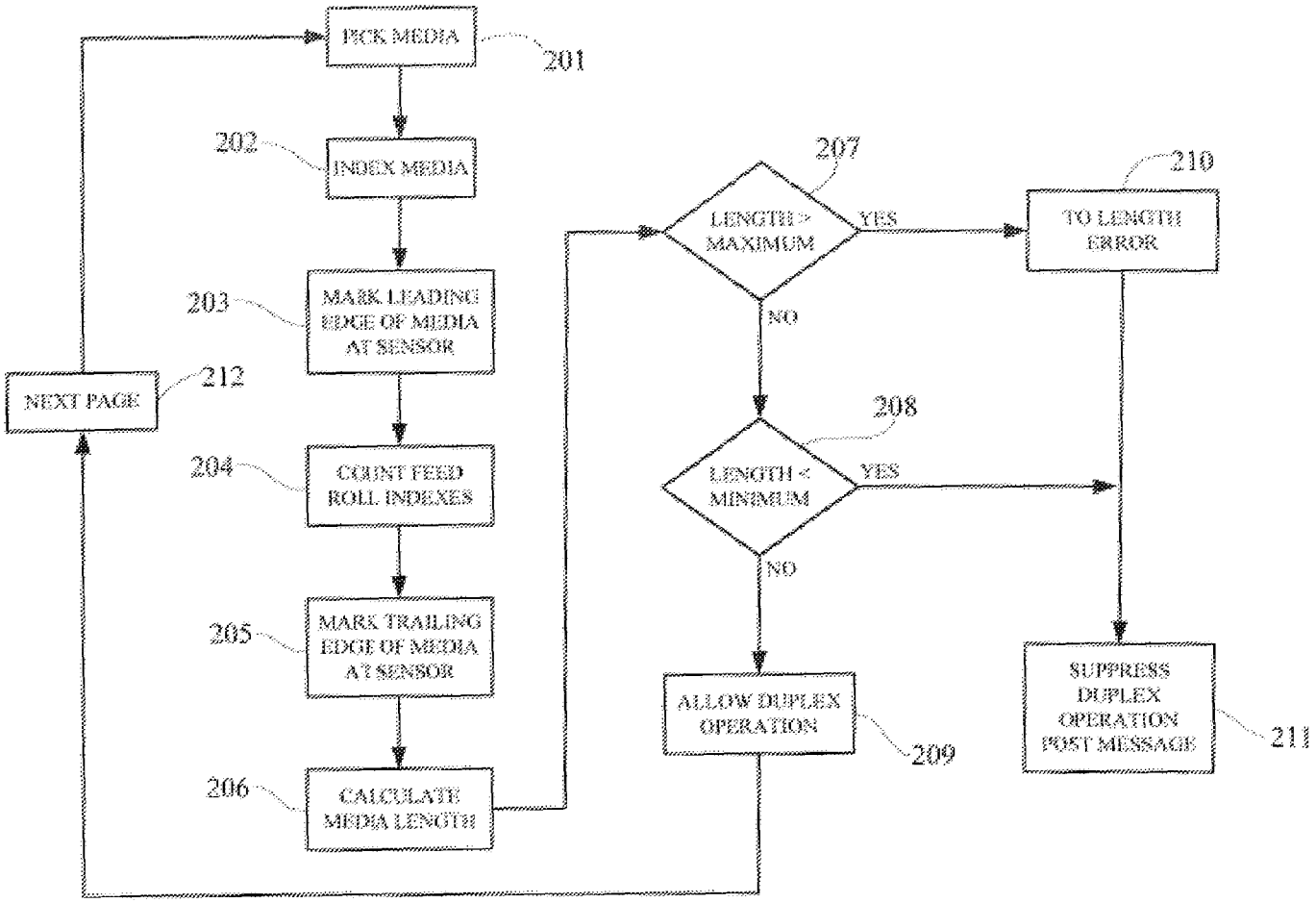

As previously described, the media M should have a minimum length greater than the distance from the feed roll nip 37, through the duplex unit 40 and through the C-path nip 36. With such minimum length requirement, the media M is not so short as to be positioned between driving rollers 37*a* and 36*b* in an undriveable position in the media feedpath 32. Therefore, before a print job is started, the user must select if duplex feeding is desired. If the user selects a duplex operation, the processor (not shown) must determine whether the media M comprises an acceptable length for duplex printing. Referring now to FIG. 12, a flow chart is depicted for determining whether a media sheet is acceptable for duplex printing. Following a selection to duplex print, the media M is picked at 201 and indexed at 202 by the pick ACM 35 and C-path ACM 36. When the media M reaches the first sensor 86 (FIG. 7), the first sensor 86 marks the leading edge of the media at 203. Subsequently, the processor counts the number of indexes of the C-path roll 36*b* and/or the feed roll 37*a* at 204. When the trailing edge of the media M reaches the end of form sensor 86, the trailing edge is marked at 205. Alternatively, the second sensor may be used to perform the media marking at 203 and 205. By counting the number of media indexes between the leading edge and trailing edge of the media, the processor calculates the media length at 206. Next the processor determines whether the media has a length greater than the maximum length acceptable for printing at 207. The media length should be less than the distance from the feed roll nip 37 through the duplex unit 40 and back to the feed roll nip 37. Otherwise, the media M would be moving two directions through the same nip, which is undesirable in the present embodiment. If the length is greater than or equal to such distance, at 210 the processor signals an error at the control panel 11 by posting a message at the LCD and suppressing the duplex operation at 211. If the length is not greater than the maximum length at 207, the processor next determines whether the media length is less than acceptable. Specifically, the processor determines whether the media M has a length which is at least a distance from the feed roll nip 37 to a C-path nip 36 at 208, but which is still less than the maximum length determined at 207. If the media length is less than the minimum distance, the duplex operation is suppressed and an error message is posted at 211 on, for example, the LCD. Alternatively, if the media length distance is determined to be of acceptable length, the duplex operation is allowed to be performed at 209. The process repeats when the next page at 212 is positioned in the input tray 22. Thus, one of ordinary skill in the art should recognize that the media length should be greater than or equal to the distance from the second nip 37, through the duplex unit 40, and to the first nip 36 but less than distance from the second nip 37, through the duplex unit 40 to second nip 37.

The foregoing description of the invention and method of use has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A removable duplex unit for an image forming peripheral having a simplex media feedpath and a reversible roller for moving media in a first direction through said imaging forming peripheral and in a second direction through said removable duplex unit, comprising:

an auxiliary housing adapted to be removably connected to said image forming peripheral, said auxiliary housing having therein a curved duplex media feedpath of a preselected length extending through said auxiliary housing in feeding communication with said reversible roller in said simplex media feedpath of the image forming peripheral, wherein said duplex media feedpath in said auxiliary housing is passive and does not provide energy to media passing through said duplex media feedpath.

2. The removable duplex unit of claim 1 wherein said duplex media feedpath is substantially C-shaped with an entry end and an exit end.

3. The removable duplex unit of claim 2 further comprising a first roller in said image forming peripheral positioned intermediate said exit end of said duplex media feedpath and said reversing roll housing, said first roller in feeding communication with said simplex media feedpath and said exit end of said duplex media path.

4. The removable duplex unit of claim 3 wherein a distance from said reversible roller through said duplex media feedpath and returning to said first roller is approximately equal to a length of media being fed therethrough.

5. The removable duplex unit of claim 2 wherein a distance, from said reversible roller through said duplex media feedpath and returning to said reversible roller is greater than a length of media being fed therethrough.

6. The removable duplex unit of claim 2, wherein said image forming peripheral has a gate operable to move to a first position for directing media being fed from said reversible roller into said entry end of said duplex media feedpath and operable to move to a second position for directing media being fed on said simplex media feedpath to said reversible roller.

7. The removable duplex unit of claim 1 further comprising a releasable connector between said image forming peripheral and said auxiliary housing.

8. The removable duplex unit of claim 1 wherein the reversible roll configured with the simplex media feedpath is one of a feed roller and an exit roller.

9. The removable duplex unit of claim 1 wherein said image forming peripheral has at least one sensor adjacent said reversible roller for determining at least one of a media leading edge position and a media trailing edge position.

10. An imaging system including an auxiliary duplex unit and an image forming, media feeding peripheral having a simplex media feedpath and a reversible roller for moving media in a first direction through said image forming peripheral and in a second direction through said auxiliary duplex unit, comprising:

a duplex housing removably connectable to said peripheral, said duplex housing having a duplex feedpath extending therethrough;

said duplex feedpath having a first end and a second end adapted for feeding communication with said simplex media feedpath; and said duplex feedpath having a length from said reversible roller configured with the simplex media feedpath, through said duplex housing, and to said reversible roller which is longer than a media sheet.

11. The imaging system of claim 10 further comprising a feedpath nip in said simplex media feedpath and disposed between said second end of said duplex feedpath path and said reversible roller.

12. The imaging system of claim 10 wherein media is driven through said duplex housing by said reversible roller configured with the simplex media feedpath and wherein no energy is added within said duplex housing to the media moving therethrough.

13. The imaging system forming 10 wherein said duplex housing is passive.

14. The imaging system of claim 10 wherein the duplex feedpath is a curvilinear feedpath that provides duplex capability to said simplex media feedpath.

15. The imaging system of claim 14 further comprising a sensor disposed along said simplex media feedpath between said second end of said duplex feedpath and said reversible roller.

16. An image forming device having a housing and a simplex media feedpath in the housing, the image forming device capable of connection to a detachable auxiliary unit having a duplex media feedpath, the image forming device performing:

directing media into said simplex media feedpath;

detecting and recording a leading edge of the media at a first location in the simplex media feedpath;

counting indexing movements of a roller in the simplex media feedpath;

detecting and recording the trailing edge of said media at the first location;

calculating media length based on said recordings and said counting, and suppressing a duplex printing operation based upon the calculation.

17. The system of claim 16, wherein the image forming device determines whether a media length is greater than a maximum length for use in the duplex media feedpath.

* * * * *